US006771299B2

(12) United States Patent
Miyagawa

(10) Patent No.: US 6,771,299 B2
(45) Date of Patent: Aug. 3, 2004

(54) MULTIBEAM EXPOSURE HEAD AND MULTIBEAM EXPOSURE APPARATUS

(75) Inventor: Ichirou Miyagawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/998,427

(22) Filed: Dec. 3, 2001

(65) Prior Publication Data

US 2002/0101501 A1 Aug. 1, 2002

(30) Foreign Application Priority Data

Dec. 1, 2000 (JP) ..... 2000-366850

(51) Int. Cl.[7] ..... B41J 15/14; B41J 27/00
(52) U.S. Cl. ..... 347/241; 347/242
(58) Field of Search ..... 347/241, 242, 347/256, 238, 244, 257, 258; 385/120, 137; 358/484

(56) References Cited

U.S. PATENT DOCUMENTS 5,196,866 A * 3/1993 Ferschl et al. ..... 347/242
6,330,019 B1 * 12/2001 Kubokawa ..... 347/241
2002/0015088 A1 * 2/2002 Inoue et al. ..... 347/238
2002/0090172 A1 * 7/2002 Okazaki et al. ..... 385/27

* cited by examiner

*Primary Examiner*—Hai Pham
(74) *Attorney, Agent, or Firm*—Sughrue Mion, PLLC

(57) ABSTRACT

The present invention relates to a multibeam exposure head having a multibeam light source which exposes a recording material by main scanning. Herein, the multibeam light source has a first multiple beam forming light source in which a plurality of beam emitting ports are arranged parallel to each other while being spaced apart from each other by a predetermined distance, and a second multiple beam forming light source in which a plurality of beam emitting ports are arranged parallel to each other being spaced apart from each other by the predetermined distance.

15 Claims, 4 Drawing Sheets

MULTIBEAM EXPOSURE HEAD AND MULTIBEAM EXPOSURE APPARATUS

BACKGROUND OF THE INVENTION

1. Field of the Invention

The present invention relates to a multibeam exposure head which exposes a recording material such as a photosensitive material, a photosensitive material or a heat-sensitive material, forming an image using multiple beams, and to a multibeam exposure apparatus using the multibeam exposure head.

2. Description of the Related Art

Conventionally, in the technical field of printing, litho-plate-making using a presensitized plate (PS plate) has widely been practiced. For example, litho-plate-making for multicolor printing is performed as described below. A color image is read using a scanner by decomposing its colors into three colors: red (R), green (G) and blue (B). Image signals representing the three colors are converted into color-decomposed halftone-dot-signals for four colors: cyan (C), magenta (M), yellow (Y) and black (Bk). Exposure printing on a photosensitive material called lith film is performed using a light beam modulated on the basis of the color-decomposed halftone-dot-signal for each color to obtain a lith plate for the corresponding color. Exposure printing of a halftone dot image in each color on a PS plate is performed using the corresponding lith plate, thus making printing plates for four colors C, M, Y and Bk for litho printing.

In recent years, however, direct plate-making and computer to plate (CTP) technology has been popular because of their advantage of simplifying the printing process and reducing the plate-making time. In direct plate-making or CTP, to make a printing plate for each of four colors C, M, Y and Bk, direct drawing on a PS plate with a light beam such as a laser is performed using the corresponding color-decomposed halftone dot signal obtained by a scanner system without making and using lith films in intermediate steps.

On the other hand, the recording density needs to be increased to 2400 dpi, 3600 dpi and 5000 dpi for increasing halftone levels and image quality of printed images. The plate-making time needs to be shortened while increasing the recording density to such a level. There is a demand for high-density drawings in a shorter time not only in the printing field but also in other various image recording fields.

However, an apparatus cannot be realized, which is capable of performing such high-density drawing with one light beam because the number of revolutions of a drum around which the PS plate needs to be fitted and which is rotated for scanning in the main scanning direction must be set to 10000 r.p.m. or greater. This can be established, considering any structural, control and manufacturing-cost conditions. By considering this problem, multibeam exposure apparatuses have been proposed in which simultaneous exposure recording for several lines is performed using one row of light beams.

Any of such multibeam exposure apparatuses use an optical fiber array or the like in the form of a row of optical fibers. The direction of one row of fibers in the optical fiber array is tilted from a main scanning direction to reduce a pitch of multiple beams emitted from the optical fiber array according to a selected resolution, thereby enabling exposure recording on a PS plate to be performed while changing resolution between various values, e.g., 2400 dpi, 3600 dpi and 5000 dpi. If an optical fiber array having a larger number of optical fibers arranged in a row is used to effectively reduce the exposure recording time at once, it is necessary to increase the number of optical fibers arranged in a row. If the number of optical fibers arranged in a row is increased, the width of arrangement of multiple beams from the optical fiber array is necessarily increased since the lower limit of pitch of the optical fibers is set depending on the fiber diameter. Further, it is necessary to correspondingly increase a size of optical system lenses for imaging with the multiple beams on the PS plate. Therefore necessity for increasing the size of the exposure apparatus arises as well as the need for using low cost performance optical system lenses, resulting in increasing manufacturing cost of the exposure apparatus.

An optical fiber array of a dual-row-structure having two rows of optical fibers arranged parallel to each other may be provided to set a certain number of beams larger than that in the single-row structure without larger optical system lenses. In an optical fiber array of such a dual-row structure, however, even if the direction of arrangement of the lower row of optical fibers, for example, is tilted from the main scanning direction to obtain the desired resolution in the same manner as that in the above-described conventional arrangement, the upper row of optical fibers does not suitably cooperate with the lower row of optical fibers, so that it is difficult to set the pitch for the desired resolution.

Further, when an optical fiber array of a dual-row structure is used, the imaging magnification may be reduced to 1/1.5 by optical system lenses to change e.g. resolution from 2400 dpi to 3600 dpi. However, because the original imaging magnification is ordinarily 0.5 or less, e.g., about 0.33, the focal depth of multiple beams immediately before exposure on the PS plate is shallow. Further, when the imaging magnification is reduced, the focal depth becomes much shallower. In such a situation, when the position of the surface of the rotating drum around which the PS plate is fitted and which is rotated for main scanning, is changed due to a small eccentricity of the drum, for example, eccentricity of about 10 $\mu$m, beam spots formed by the multiple beams are defocused by this change. The beam spots of the multiple beams are also defocused owing to a small curvature in the optical system lenses. Therefore, an excessive reduction in imaging magnification caused by optical system lenses must be avoided and it is practically impossible to reduce the imaging magnification by 50% or more for a change of resolution by using optical system lenses.

SUMMARY OF THE INVENTION

In view of the above-mentioned problems, it is an object of the present invention to provide a multibeam exposure head and a multibeam exposure apparatus arranged to perform image exposure recording at a desired resolution with substantially no change in imaging magnification of the optical system by using an optical fiber array of a dual-row-structure.

In order to attain the above object, the following aspects will be provided by the preset invention.

The first aspect of the present invention is characterized by a multibeam exposure head having a multibeam light source which exposes a recording material by main scanning, the multibeam light source having a first multiple beam forming light source in which a plurality of beam emitting ports are arranged parallel to each other while being spaced apart from each other by a predetermined distance, and a second multiple beam forming light source in which a plurality of beam emitting ports are arranged parallel to each other being spaced from each other by the predetermined distance, the plurality of beam emitting ports in the second multiple beam forming light source being placed parallel to the parallel arrangement direction of the beam emitting ports in the first multiple beam forming light source while being spaced apart by a predetermined distance from the same, and the position of the beam emitting port at one end of the second multiple beam forming light source being shifted in the parallel direction relative to the position of the beam emitting port at the corresponding end of the first multiple beam forming light source.

Further it is preferable that the head further has a tilt angle changing unit which makes, by rotating the multibeam light source, a change in exposure condition from a first exposure condition in which each of first multiple beams emitted from the first multiple beam forming light source and each of second multiple beams emitted from the second multiple beam forming light source are alternatively arranged at an equal interval in a subscanning direction perpendicular to the direction of main scanning on the recording material, to a second exposure condition in which each of the first multiple beams and each of the second multiple beams are alternatively arranged at an equal interval in a subscanning direction.

Further it is preferable that the head further has an optical system in an optical path between the multibeam light source and the recording material, from a first beam pitch formed on the recording material through the optical system by each of the first multiple beams and the second multiple beams alternatively arranged at equal intervals in the subscanning direction under the first exposure condition, the multibeam light source being rotated by using the tilt angle changing unit to form a desired second beam pitch on the recording material through the imaging optical system by each of the first multiple beams and the second multiple beams alternatively arranged at equal intervals in the subscanning direction under the second exposure condition.

Further it is preferable that the head in a case where the arrangement distance of the beam emitting ports is $D_f$, the first beam pitch is P; the second beam pitch is Q; and imaging magnification of the optical system is M, and in a case where a distance by which the first multiple beam forming light source and the second multiple beam forming light source are spaced apart from each other by a predetermined distance is $W_f$, then $W_f$ obtained by the following equation (1) is set:

$$W_f = L\cdot\cos(\theta_a+\Phi_1)/M \quad (1)$$

where $L=(((2\cdot n-1)\cdot Q+P\cdot\cos(\Delta\theta))/\sin(\Delta\theta))^2+P^2)^{1/2}$, $\theta_a=\cos^{-1}(2\cdot P/(D_f\cdot M))$, $\Phi_1=\sin^{-1}(P/((((2\cdot n-1)\cdot Q+P\cdot\cos(\Delta\theta))/\sin(\Delta\theta))^2+P^2)^{1/2})$, $\Delta\theta=\cos^{-1}(2\cdot Q/(D_f\cdot M))=\cos^{-1}(2\cdot P/(D_f\cdot M))$, and n is a natural number.

Further it is preferable that the head in a case where a width by which the position of the beam emitting port of the second multiple beam forming light source is shifted in the parallel arrangement direction relative to the position of the beam emitting port of the first multiple beam forming light source is $A_f$, then $A_f$ obtained by the following equation (2) is set:

$$A_f=(W_f\cdot M\cdot\sin(\theta_a)+P)/(\cos(\theta_a)\cdot M) \quad (2)$$

Further it is preferable that the head of the optical system have a lens which finely adjusts imaging magnification of the optical system, the lens being provided in an optical path of the first multiple beams and the second multiple beams.

Further it is preferable that the head includes the multibeam light source having an optical fiber array.

The second aspect of the present invention is characterized by a multibeam apparatus having the multibeam exposure head described above according to the first aspect and an outer drum capable of performing main scanning on the recording material by having the recording material fitted and rotated around its outer cylindrical surface.

DESCRIPTION OF THE PREFERRED EMBODIMENT

A multibeam exposure apparatus using a multibeam exposure head in accordance with the present invention will be described in detail as a preferred embodiment with reference to the accompanying drawings.

Figure 1:
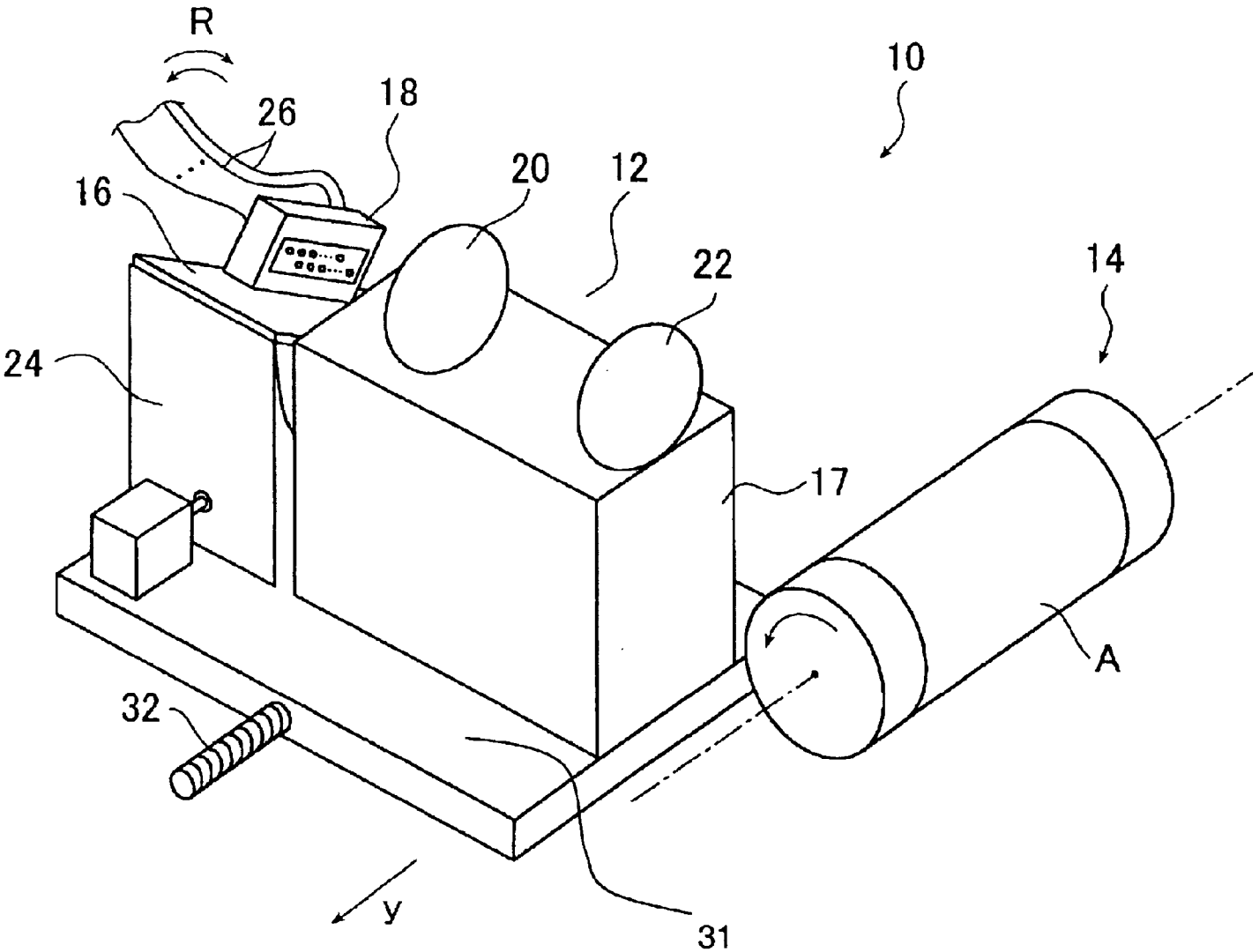
FIG. 1 is a schematic perspective view of a multibeam exposure apparatus using a multibeam exposure head in an embodiment of the present invention.

FIG. 1 shows a multibeam exposure apparatus (hereinafter referred to simply as "exposure apparatus") 10 which represents a preferred embodiment of the present invention.

The exposure apparatus 10 is for performing exposure recording of an image by emitting multiple beams modulated according to an image signal and by an optical system for forming an image on a recording material A such as a PS plate. The exposure apparatus 10 mainly has a multibeam exposure head 12 and an outer drum 14.

The multibeam exposure head 12 is mainly constituted by a base 16, a multibeam light source 18 fixed on the base 16, a collimator lens 20, an imaging lens 22, and an exposure head tilt angle changing device 24.

The multibeam light source 18 is disposed on and fixed to the base 16, which is fixed on the tilt angle changing device 24. The multibeam light source 18 is rotatable in each of the directions of arrows R.

The multibeam light source 18 is a fiber array typed light source having a fiber array formed by 64 optical fibers having their end surfaces formed as emitting ports at their one ends so as to flush with each other. Through the emitting ports, multiple beams incident on the other end surfaces of the optical fibers are emitted. The multiple beams are formed by a plurality of beams of laser light emitted from a semiconductor laser device (not shown) such as a laser diode. The ON/OFF statuses of the laser beams are controlled according to an image signal. The laser beams enter the optical fibers through the end surfaces of the same coupled to laser light emitting surfaces of the semiconductor laser device by a semiconductor laser device and fiber coupling unit (not shown).

Figure 2:
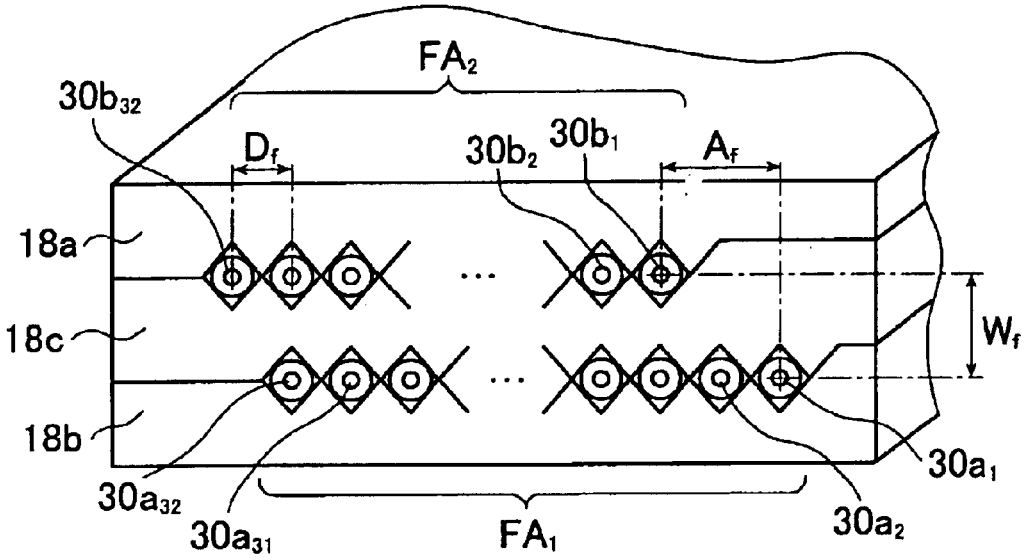
FIG. 2 is a schematic perspective view of an essential portion of the multibeam exposure head shown in FIG. 1.

The optical fiber array of the multiple beam light source 18 is fixed to a predetermined position using fixing members 18*a*, 18*b*, and 18*c*, as shown in FIG. 2. In the present invention, the number of emitting ports formed by optical fibers is not particularly limited to 64 ports.

The optical fiber array is formed by two rows of optical fibers, i.e., an optical fiber array $FA_1$ of 32 numbers of optical fibers, and another optical fiber array $FA_2$ of 32 numbers of optical fibers.

In the optical fiber array $FA_1$, beam emitting ports $\mathbf{30}a_1$ to $\mathbf{30}a_{32}$ are arranged in one direction between the fixing members 18*a* and 18*c*. In the optical fiber array $FA_2$, beam emitting ports $\mathbf{30}b_1$ to $\mathbf{30}b_{32}$ are arranged between the fixing members 18*c* and 18*b* parallel to the direction of arrangement of the beam emitting ports in the optical fiber array $FA_1$.

The beam emitting ports $\mathbf{30}a_1$ to $\mathbf{30}a_{32}$ in the optical fiber array $FA_1$ and the beam emitting ports $\mathbf{30}b_1$ to $\mathbf{30}b_{32}$ in the optical fiber array $FA_2$ are arranged by a pitch (arrangement pitch) $D_f$. The beam emitting port $\mathbf{30}a_1$ at one end of the optical fiber array $FA_1$ is shifted by a distance (parallel arrangement direction shift distance) $A_f$ relative to the beam emitting port $\mathbf{30}b_1$ at the corresponding end of the optical fiber array $FA_2$. Further, the row of beam emitting ports $\mathbf{30}a_1$ to $\mathbf{30}a_{32}$ forming the optical fiber array $FA_1$ and the row of beam emitting ports $\mathbf{30}b_1$ to $\mathbf{30}b_{32}$ forming the optical fiber array $FA_2$ are spaced from each other by a distance (multiple beam forming light source distance) $W_f$.

The collimator lens 20 and the imaging lens 22 are fixed to an optical system base 17 to form a reduction optical system for forming an image using multiple beams emitted from the optical fiber array $FA_1$ and the optical fiber array $FA_2$ of the multibeam light source 18, the reduction optical system having an effect of reducing the multiple beams at the image forming point. The reduction optical system formed by the collimator lens 20 and the imaging lens 22 in this embodiment is not exclusively used. In the present invention, any reduction optical system may be used if it has effect of reducing, at the imaging point, the multiple beams emitted from the multibeam light source 18. For example, a plurality of optical systems may be combined to form the reduction optical system.

The outer drum 14 is rotated along a main scanning direction with recording material A such as a PS plate fitted around its outer cylindrical surface. The outer drum 14 is connected to a drive source (not shown) and rotates at a predetermined rotational speed.

The exposure head tilt angle changing device 24 is for rotating, in each direction R, the base 16 on which the multibeam light source 18 is fixed. The exposure head tilt angle changing device 24 corresponds to the tilt angle changing unit in accordance with the present invention.

The exposure head tilt angle changing device 24 is rotated about an axis of rotation, which is parallel to the multiple beam emitting direction, passing through a center between the optical fiber array $FA_1$ and the optical fiber array $FA_2$ of the multibeam light source 18.

Figure 3:
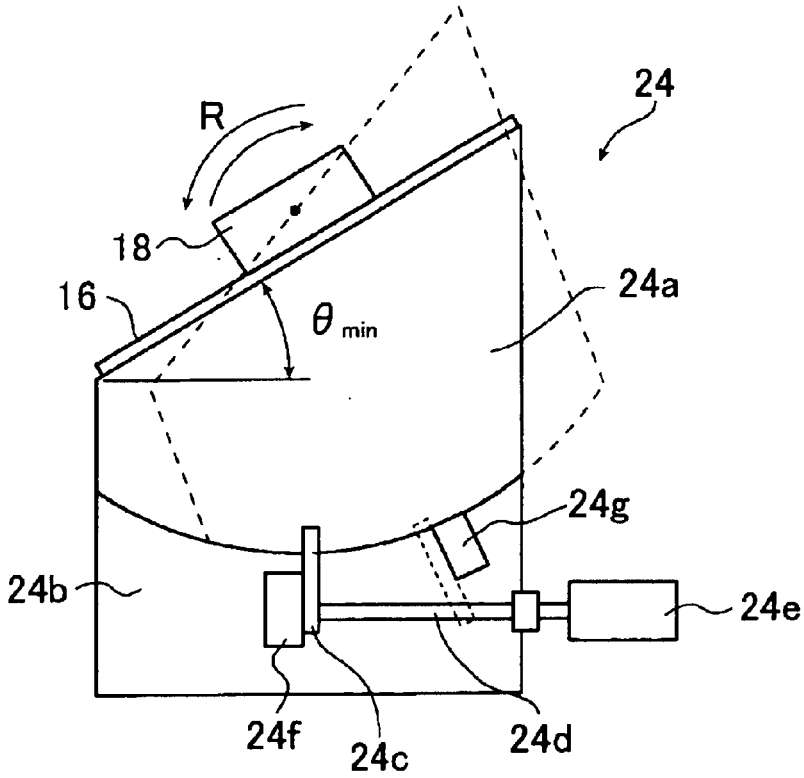
FIG. 3 is a diagram showing the construction of a tilt angle changing device used in the multibeam exposure head shown in FIG. 1.

FIG. 3 schematically shows the exposure head tilt angle changing device 24 as viewed in the direction toward the outer drum 14 from a position at the rear of the multibeam light source 18.

The tilt angle changing device 24 is mainly constituted by a rotary unit 24*a* and a base unit 24*b*.

The rotary unit 24*a* is rotatable in each direction R relative to the base unit 24*b* while being controlled using an adjustment rod 24*d* connected to a projecting member 24*c* fixed on the rotary unit 24*a*, and which is horizontally expandable by a drive unit 24*e* as viewed in FIG. 3.

A mechanism which rotates the rotary unit 24*a* is constituted using a well-known gear mechanism or the like so that the tilt angle of the rotary unit 24 can be set with accuracy. To change the tilt angle of the optical fiber array $FA_1$ and the optical fiber array $FA_2$ of the multibeam light source 18, the rotary unit 24*a* is rotated to be set at a predetermined tilt angle.

Members 24*f* and 24*g* are provided in order to limit the tilt angle within a predetermined range by limiting movement of the projecting member 24*c* fixed to the rotary unit 24*a*. The tilt angle can freely be adjusted as long as the projecting member 24*c* is movable between the members 24*f* and 24*g*.

As shown in FIG. 3, the tilt angle is $\theta_{min}$. As understood from the placed position of the member 24*f* shown in FIG. 3, the tilt angle is not zero when minimized (the fiber arrays are not horizontal). The tilt angle in the state shown in FIG. 3 lies at the minimum.

The tilt angle changing device 24 and the optical system base 17 are fixed on a movable table 31, which has a female thread meshing with a drive screw 32 connected to a rotary drive source (not shown). As the drive screw 32 rotates, the base unit 24*b* moves in the y-direction (subscanning direction) shown in FIG. 1. That is, the female thread and the drive screw 32 form a subscanning mechanism for being moved together in the y-direction the tilt angle changing device 24, the multibeam light source 18 disposed on the tilt angle changing device 24, and the collimator lens 20 and the imaging lens 22 fixed to the optical system base 17.

After recording material A around the outer drum 14 has been exposed to light in the multiple beams emitted from the optical fiber array $FA_1$ and the optical fiber array $FA_2$ by making one round, the subscanning mechanism moves the multibeam exposure head 12 in the y-direction through the distance in the subscanning direction corresponding to the width of the area of the recording material A exposed to the light from the optical fiber array $FA_1$ and the optical fiber array $FA_2$. Thus, exposure recording from end to end on recording material A around the outer drum 14 is performed with the multibeam exposure head 12.

The subscanning mechanism constituted by the drive screw 32 and the female thread meshing with each other in this embodiment is not exclusively used. Any subscanning mechanism may be used if the base unit 24*b* can be moved in the y-direction.

In the exposure apparatus 10, the tilt angle of the optical fiber arrays $FA_1$ and $FA_2$ is determined by tilting the multibeam exposure head 12 at a predetermined angle in the direction R to set a desired beam pitch on recording material A. The optical fiber arrays $FA_1$ and $FA_2$ are spaced apart from each other by a predetermined distance, and the position of the beam emitting port at one end of the optical fiber array $FA_2$ is shifted in the parallel arrangement direction relative to the position of the beam emitting port at the corresponding end of the optical fiber array $FA_1$, thereby enabling at least between two values of the beam pitch to be efficiently changed by changing the above-described tilt angle.

In this case, resolution of exposure recording on recording material A can be changed without changing the imaging magnification. That is, the tilt angle of the optical fiber array $FA_1$ and the optical fiber array $FA_2$ is changed through a predetermined angle using the tilt angle changing device 24 to change from the beam pitch in the direction of sub scanning on recording material A (y-direction) in the arrangement of beam spots formed by alternately positioning each of the multiple beams from the optical fiber array $FA_1$ and each of the multiple beams from the optical fiber array $FA_2$ to the beam pitch in the direction of sub scanning on recording material A (y-direction) in the arrangement of beam spots formed by alternately positioning each of the multiple beams emitted from the optical fiber array $FA_2$.

It is preferred that the multiple beam forming light source distance $W_f$ and the parallel arrangement direction shift distance $A_f$ in the above-described arrangement be determined by equations (1) and (2). The reason of determination of these distances by equations (1) and (2) will be described.

Figure 4:
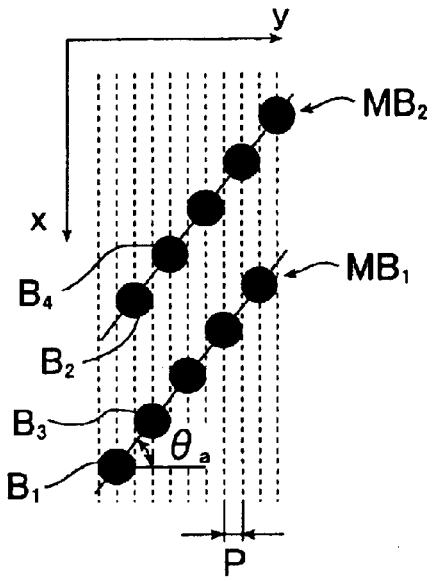
FIG. 4 is a diagram showing the state of beam spots on a recording surface in the multibeam exposure apparatus shown in FIG. 1.
Figure 5:
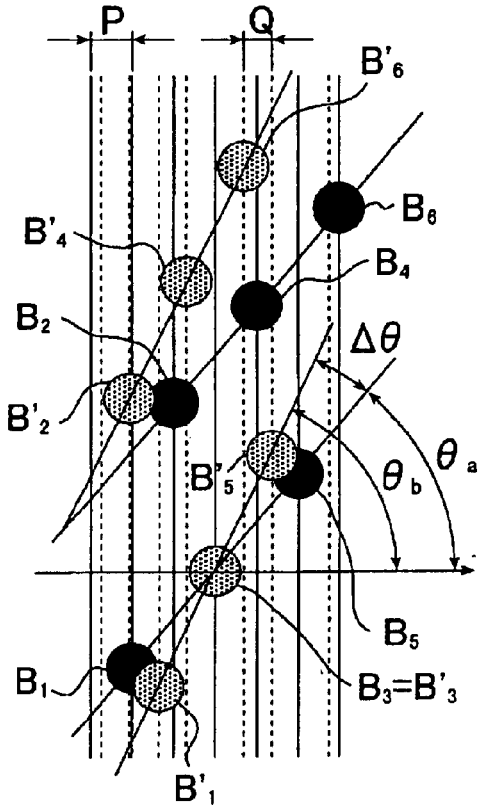
FIG. 5 is a diagram showing the movements of beam spots on the recording surface when the tilt angle is changed in the multibeam exposure apparatus shown in FIG. 1.

A case will be described in which the tilt angle changing device 24 is operated to make a change in exposure condition from a beam pitch P, such as shown in FIG. 4, in the direction of sub scanning on recording material A (y-direction) in the arrangement of beam spots $B_1$, $B_2$, $B_3$, $B_4$ . . . formed by alternately positioning multiple beams $MB_1$ emitted from the optical fiber array $FA_1$ and multiple beams $MB_2$ emitted from the optical fiber array $FA_2$, which beam pitch is set by tilting the rows of beam spots at a tilt angle $\theta_a$, to a beam pitch Q, such as shown in FIG. 5, in the direction of sub scanning on recording material A (y-direction) of beam spots $B'_1$, $B'_2$, $B'_3$, $B'_4$ . . . formed by alternately positioning multiple beams $MB_1$ emitted from the optical fiber array $FA_1$ and multiple beams $MB_2$ emitted from the optical fiber array $FA_2$ in the sub scanning direction, which beam pitch is set by tilting the rows of beam spots at a tilt angle $\theta_b$ (the tilt angle changing device 24 rotates the optical fiber arrays $FA_1$ and $FA_2$ by an angle of ($\theta_b=\theta_a$).

Simply put, it is assumed here that, as shown in FIG. 5, the beam spot $B_3$ corresponds to the center of rotation for the change in tilt angle from $\theta_a$ to $\theta_b$, and imaging with multiple beams $MB_1$ and $MB_2$ on recording material A is performed at an imaging magnification M. An equation (5) shown below is obtained from the following equations (3) and (4). $\Delta\theta$ in equation (5) represents the angle of rotation for changing the tilt angle by using the tilt angle changing device 24.

$$\cos(\theta_a)=2\cdot P/(D_f\cdot M) \tag{3}$$

$$\cos(\theta_b)=2\cdot Q/(D_f\cdot M) \tag{4}$$

$$\Delta\theta=\cos^{-1}(2\cdot Q/(D_f\cdot M))-\cos^{-1}(2\cdot P/(D_f\cdot M)) \tag{5}$$

The positional relationship between the beam spots $B_3$, $B_4$, and $B'_4$ when this change is made is examined to obtain the following equations (6) to (8):

$$\sin(\Phi_1)=P/L \tag{6}$$

$$\sin(\Phi_2)=(2\cdot n-1)\cdot Q/L \tag{7}$$

$$\Delta\theta=\Phi_1+\Phi_2 \tag{8}$$

Figure 6:
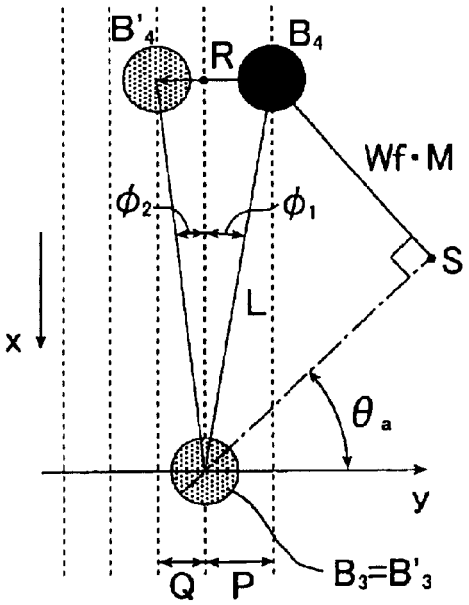
FIG. 6 is a diagram showing the movement of one beam spot on the recording surface when the tilt angle is changed in the multibeam exposure apparatus shown in FIG. 1.

Referring to FIG. 6, equation (6) is obtained with reference to a right triangle (substantially right angled triangle) formed by a center point in the beam spot $B_3$, a center point in the beam spot $B_4$ and a point R shown in FIG. 6. Equation (7) is obtained with reference to a right triangle (substantially right angled triangle) formed by the center point in the beam spot $B_3$, a center point in the beam spot $B'_4$ and the point R. The point R is a point of intersection of a straight line in the main scanning direction passing through the center point in the beam spot $B_3$ (=$B'_3$) and a locus of the center point in the beam spot $B_4$ when the beam spot $B_4$ moves to the beam spot $B'_4$.

Equation (9) is obtained from equations (6) to (8).

$$L=(((2\cdot n-1)\cdot Q+P\cdot\cos(\Delta\theta))/\sin(\Delta\theta))^2+P^2)^{1/2} \tag{9}$$

Figure 7:
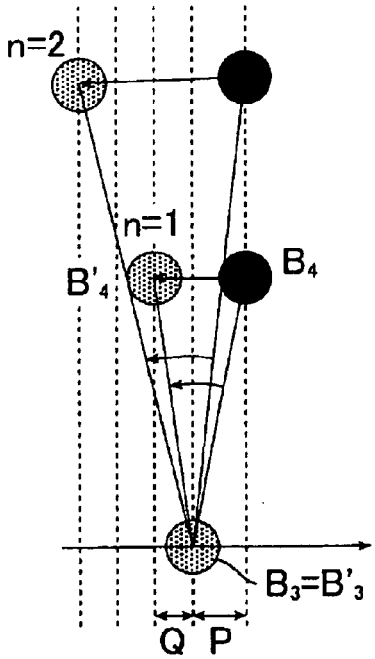
FIG. 7 is another diagram showing the movement of one beam spot on the recording surface when the tilt angle is changed in the multibeam exposure apparatus shown in FIG. 1.

In this equation, n is a natural number such as 1, 2, 3, . . . . The number n=1 corresponds to a case where, as shown in FIG. 7, the center of the beam spot $B_4$ moves across the straight line extending in the main scanning direction and passing through the center point in the beam spot $B_3$ (=$B'_3$) to a position spaced apart from this straight line by the original beam pitch Q. The number of n=2 corresponds to a case where, as shown in FIG. 7, the center of the beam spot $B_4$ moves across the straight line extending in the main scanning direction and passing through the center point in the beam spot $B_3$ (=$B'_3$) to a position spaced apart from this straight line by three times greater than the beam pitch Q. Thus, by a setting of natural number n, the center of the beam spot $B_4$ moves across the straight line extending in the main scanning direction and passing through the center point in the beam spot $B_3$ (=$B'_3$) to a position spaced apart from this straight line by $(2\cdot n-1)\cdot Q$.

The following equation (10) is obtained with reference to a right triangle formed by the center point in the beam spot $B_3$, the center point in the beam spot $B_4$ and a point S in FIG. 6.

$$W_f=L\cdot\sin(\pi/2-\theta_a-\Phi_1)/M=L\cdot\cos(\theta_a=\Phi_1)/M \tag{10}$$

Equation (1) can be obtained by substituting in equation (10), L shown by equation (9).

In equation (1), the multiple beam forming light source distance $W_f$ can be obtained by determining the beam pitch P, the beam pitch Q, the natural number n and the arrangement distance $D_f$.

Figure 8A:
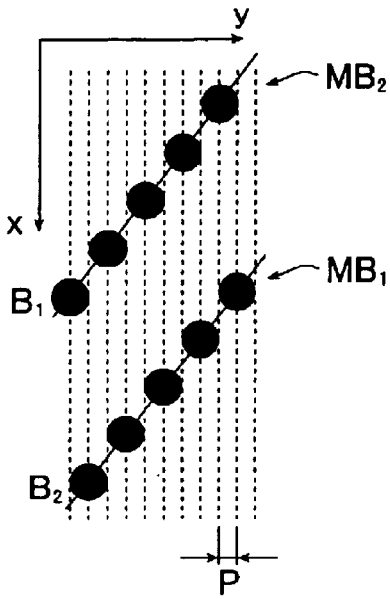
FIGS. 8A to 8D are diagrams showing the arrangement of beam spots in the multibeam exposure apparatus shown in FIG. 1.
Figure 8B:
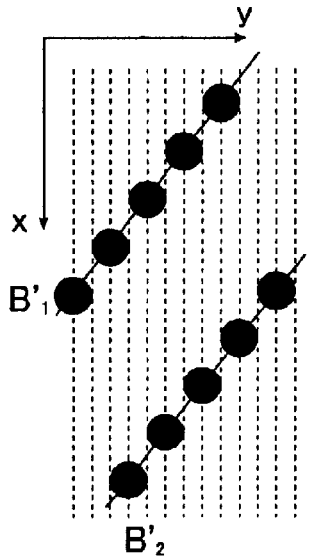

The parallel arrangement direction shift distance $A_f$ is obtained by equation (2) using the multiple beam forming light source distance $W_f$ obtained by equation (1). Equation (2) is obtained by considering a problem described below. Referring to FIG. 8A, in a case where a straight line connecting the center point in the multiple beam $MB_2$ spot $B_1$ at one end in the subscanning direction (y-direction) of the constellation of beam spots formed by the multiple beams $MB_1$ and $MB_2$ and the center point in the multiple beam $MB_1$ spot $B_2$ next to the spot $B_1$ in the subscanning direction has a tilt to the left from the main scanning direction (x-direction), and where a change in exposure condition for a higher resolution is made by increasing the tilt angle from this state, the deviation of the straight line from the main scanning direction (x-direction) may be so large that the beam spot $B'_1$ formed as a result of the movement of the beam spot $B_1$ is separated two beam pitches from the beam spot $B'_2$ formed as a result of the movement of the beam spot $B_2$, as shown in FIG. 8B, resulting in occurrence of an exposure recording defect by one pitch.

Figure 8C:
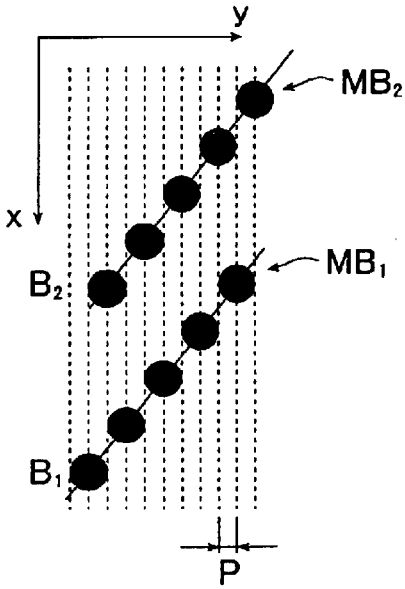

In the present invention, it is preferred that, as shown in FIG. 8C, the straight line connecting the center point in the multiple beam $MB_2$ spot $B_1$ at one end in the subscanning direction (y-direction) of the constellation of beam spots formed by the multiple beams $MB_1$ and $MB_2$ and the center point in the multiple beam $MB_1$ spot $B_2$ next to the spot $B_1$ in the subscanning direction have a tilt in the same direction as the direction of tilt of the multiple beams MB1 and MB2, i.e., a tilt to the right as viewed in FIG. 8C.

Figure 8D:
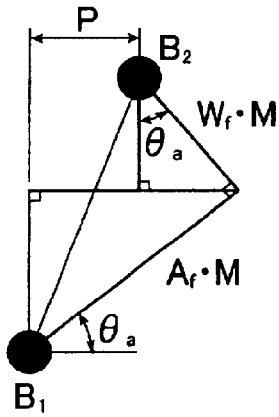

As such a setting condition, equation (2) is obtained through the following equation (11) obtained by considering two triangles shown in FIG. 8D.

$$A_f M \cdot \cos(\theta_a) = P + W_f M \cdot \sin(\theta_a) \quad (11)$$

In equation (2), the parallel arrangement direction shift distance $A_f$ can be obtained by determining the beam pitch P, the beam pitch Q, the natural number n and the arrangement distance $D_f$, as in equation (1).

In this embodiment, likewise the method of determining the multiple beam forming light source distance $W_f$ and the parallel arrangement direction shift distance $A_f$ respectively calculated by equations (1) and (2) is applied to an optical fiber array of a dual-row configuration such as shown in FIG. 2 to make it possible to meet an exposure condition for a target beam pitch determining the resolution in the subscanning direction by only rotating the multibeam light source 18 by a predetermined angle using the tilt angle changing device 24.

To reduce the beam pitch distance in the thus-arranged exposure apparatus 10, rotation by $\Delta\theta$ shown by equation (9) is caused by operating the tilt angle changing device 24 for change from a low-resolution coarse-beam-pitch exposure condition based on the tilt angle θa of the direction of arrangement of multiple beams MB1 and MB2 from the subscanning direction (y-direction) to a condition based on the tilt angle θb. The beam pitch in the subscanning direction is thereby set to the desired pitch distance.

If n=1, beam spots $B_1$, $B_3$, $B_5$ . . . and beam spots $B_2$, $B_4$, $B_6$ . . . of multiple beams $MB_1$ and $MB_2$ move to beam spots $B'_1$, $B'_3$, $B'_5$ . . . and beam spots $B'_2$, $B'_4$, $B'_6$, as shown in FIG. 5. In this case, since the multiple beam forming light source distance $W_f$ and the parallel arrangement direction shift distance $A_f$ have been set in the multibeam light source 18 using equations (1) and (2), the beam pitch becomes equal to the target pitch.

With the reduction in beam pitch in the subscanning direction, the rotational speed of the outer drum 14 is reduced to adjust the beam pitch in the main scanning direction (x-direction).

Table 1 shows concrete examples of the values of the multiple beam forming light source distance $W_f$ and the parallel arrangement direction shift distance $A_f$ in the exposure apparatus 10.

In set 1, $W_f$ is set to 117.3 μm and $A_f$ is set to 271.8 μm. An increase of 10.4 degrees in tilt angle from the tilt angle $\theta_a$, 60.4 degrees is thereby caused to set the tilt angle $\theta_b$ to 70.8 degrees. This setting enables the resolution to be readily changed from 2400 dpi, corresponding to a beam pitch of 10.5833 μm, to 3600 dpi, corresponding to a beam pitch of 7.0555 μm.

In set 2, $W_f$ is set to 234.6 μm and $A_f$ is set to 478.6 μm. An increase of 10.4 degrees in tilt angle from the tilt angle $\theta_a$, 60.4 degrees is thereby caused to set the tilt angle $\theta_b$ to 70.8 degrees. This setting enables the resolution to be readily changed from 2400 dpi, corresponding to a beam pitch of 10.5833 μm, to 3600 dpi, corresponding to a beam pitch of 7.0555 μm.

In set 3, $W_f$ is set to 234.0 μm and $A_f$ is set to 477.6 μm. An increase of 13.34 degrees in tilt angle from the tilt angle $\theta_a$, 60.4 degrees is thereby caused to set the tilt angle $\theta_b$ to 73.7 degrees. This setting enables the resolution to be readily changed from 2400 dpi, corresponding to a beam pitch of 10.5833 μm, to 4230 dpi, corresponding to a beam pitch of 6.005 μm.

In set 4, $W_f$ is set to 234.5 μm and $A_f$ is set to 478.4 μm. An increase of 15.5 degrees in tilt angle from the tilt angle $\theta_a$, 60.4 degrees is thereby caused to set the tilt angle $\theta_b$ to 75.9 degrees. This setting enables the resolution to be readily changed from 2400 dpi, corresponding to a beam pitch of 10.5833 μm, to 4860 dpi, corresponding to a beam pitch of 5.2263 μm.

Figure 9:
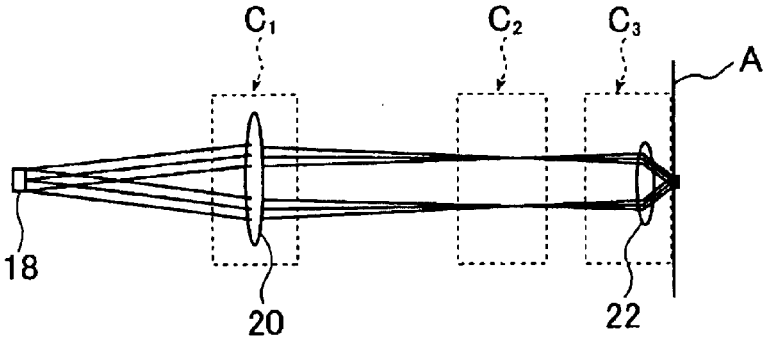
FIG. 9 is a diagram showing the position at which a fine magnification adjustment lens is placed in the multibeam exposure apparatus shown in FIG. 1.

Since approximately the same values of $W_f$ and $A_f$ are used in sets 2 to 4, a change in resolution to 4230 dpi corresponding to a beam pitch of substantially 6.005 μm can easily made by using the values of $W_f$ and $A_f$ selected in setting 2 and by causing an increase of 13.34 degrees from the tilt angle $\theta_a$, 60.4 degrees. Also, change in resolution to 4860 dpi corresponding to a beam pitch of about 6.005 μm can easily be made by causing an increase of 15.5 degrees from the tilt angle $\theta_a$, 60.4 degrees. In this case, a fine magnification adjustment lens for finely adjusting the imaging magnification may be inserted in the optical path for multiple beams $MB_1$ and $MB_2$ to adjust the resolution to 4200 dpi or 5000 dpi. For example, it is preferable to dispose a fine magnification adjustment lens in a region $C_1$, $C_2$, or $C_3$ shown in FIG. 9. In such a case, imaging magnification fine adjustment by only 10% or less from 4230 dpi to 4200 dpi or 4860 dpi to 5000 dpi may be performed by using the fine magnification adjustment lens. This imaging magnification fine adjustment does not include largely changing the imaging magnification, e.g., changing the imaging magnification by 50% from 2400 dpi to 3600 dpi, as in the conventional adjustment method, and is therefore free from the problem

TABLE 1

| | (Setting Conditions) | | | |
|---|---|---|---|---|
| | Set 1 | Set 2 | Set 3 | Set 4 |
| Arrangement distance $D_f$ | 130 (μm) | 130 (μm) | 130 (μm) | 130 (μm) |
| Imaging magnification M | 0.33 | 0.33 | 0.33 | 0.33 |
| Natural number n | 1 | 2 | 3 | 4 |
| Multiple beam forming light source distance $W_f$ | 117.3 (μm) | 234.6 (μm) | 234.0 (μm) | 234.5 (μm) |
| Parallel arrangement direction shift distance $A_f$ | 271.8 (μm) | 478.6 (μm) | 477.6 (μm) | 478.4 (μm) |
| | 2400 dPi ($\theta_a$ = 60.4°) ↓ 3600 dPi ($\theta_b$ = 70.80°) | 2400 dPi ($\theta_a$ = 60.4°) ↓ 3600 dPi ($\theta_b$ = 70.80°) | 2400 dPi ($\theta_a$ = 60.4°) ↓ 4230 dPi ($\theta_b$ = 73.74°) | 2400 dPi ($\theta_a$ = 60.4°) ↓ 4860 dPi ($\theta_b$ = 75.90°) |

of defocusing of recording beam spots, which has been a consideration. Moreover, since the rate of magnification adjustment is 10% or less, there is no need for a large high-priced optical system lens, so that cost performance of provision of the optical system can be improved.

For example, the values of $W_f$ and $A_f$ in set 3 are used. By tilting by 13.7 degrees from $\theta_a$ the tilt angle $\theta_b$ is set as 73.7 degrees. Further, a fine magnification adjustment lens is used to finely adjust the imaging magnification from 0.33 to 0.3323 (0.33×4230/4200). Resolution of 4200 dpi is thereby changed.

Also, in the case where the values of $W_f$ and $A_f$ in setting 4 are used and tilting by 15.5 degrees from $\theta_a$ is performed to set the tilt angle $\theta_b$ as 75.9 degrees, a fine magnification adjustment lens may be used to finely adjust the imaging magnification from 0.33 to 0.32076 (0.33×4860/5000), thereby setting resolution to 5000 dpi.

The multibeam exposure head and the multibeam exposure apparatus in accordance with the present invention have been described in detail. Needless to say, the present invention is not limited to the above-described embodiment and various modifications and changes may be made in the described embodiment without departing from the scope of the invention.

As above-mentioned in detail, the two rows of optical fibers forming optical fiber arrays placed parallel to each other are apart by a predetermined distance, and the position of the beam emitting port at one end of one of the optical fiber arrays is shifted in the parallel arrangement direction relative to the position of the beam emitting port at the corresponding end of the other optical fiber array. Therefore a beam pitch in the arrangement of the beams for recording on a recording material can be changed between at least two values by changing the tilt angle. In particular, the optical fiber array placement dimensions are prescribed by equations (1) and (2) to make it possible to set an exposure condition for a target pitch determining resolution in the subscanning direction by merely rotating the light source through a predetermined angle with the exposure head tilt angle changing device. Further, if a fine magnification adjustment lens is used, a plurality of high-resolution exposure conditions can be set while exposure recording free from defocusing of the beam spots is ensured. Further, cost performance of provision of the optical system can be improved in comparison with the conventional apparatus requiring large and expensive optical system lenses for changing the imaging magnification by 50% or more.

What is claimed is:

1. A multibeam exposure head comprising:

a multibeam light source which exposes a recording material by main scanning, said multibeam light source having a first multiple beam forming light source in which a plurality of beam emitting ports are arranged parallel to each other while being spaced apart from each other by a predetermined distance, and a second multiple beam forming light source in which a plurality of beam emitting ports are arranged parallel to each other being spaced apart from each other by said predetermined distance, wherein said plurality of beam emitting ports in said second multiple beam forming light source are placed parallel to the parallel arrangement direction of the beam emitting ports in said first multiple beam forming light source while being spaced apart by a predetermined distance from the same, and the position of the beam emitting port at one end of said second multiple beam forming light source being shifted in the parallel direction relative to the position of the beam emitting port at the corresponding end of said first multiple beam forming light source; and a tilt angle changing unit which makes, by rotating said multibeam light source, a change in exposure condition from a first exposure condition in which each of first multiple beams emitted from said first multiple beam forming light source and each of second multiple beams emitted from said second multiple beam forming light source are alternatively arranged at a first equal interval in a subscanning direction perpendicular to the direction of main scanning on a recording material, to a second exposure condition in which each of the first multiple beams and each of the second multiple beams are alternatively arranged at a second equal interval in the subscanning direction.

2. The multibeam exposure head according to claim 1, further comprising an optical system in an optical path between said multibeam light source and the recording material, from a first beam pitch formed on the recording material through said optical system by each of the first multiple beams and the second multiple beams alternatively arranged at first equal intervals in the subscanning direction under the first exposure condition, said multibeam light source being rotated by using said tilt angle changing unit to form a desired second beam pitch on the recording material through said optical system by each of the first multiple beams and the second multiple beams alternatively arranged at second equal intervals in the subscanning direction under the second exposure condition.

3. The multibeam exposure head according to claim 2, wherein said optical system has a lens which finely adjusts imaging magnification of said optical system, said lens being provided in an optical path of the first multiple beams and the second multiple beams.

4. The multibeam exposure head according to claim 2, further comprising a collimator lens and an imaging lens for reducing multiple beams at an image forming point.

5. The multibeam exposure head according to claim 1, wherein if the arrangement distance of said beam emitting ports is $D_f$; said first beam pitch is P; said second beam pitch is Q; imaging magnification of an optical system for said multibeam light source is M; $\theta_a$ is a tilt angle of said beam emitting ports; $\Phi_1$ is a position of said beam emitting ports; $\Delta\theta$ is an angle of rotation for changing a tilt angle; and L is a length of a side of a right triangle formed by a center point of a beam emitting port and if a distance by which said first multiple beam forming light source and said second multiple beam forming light source are spaced apart from each other by a predetermined distance is $W_f$, then $W_f$ obtained by the following equation (1) is set:

$$W_f L\cdot\cos(\theta_a+\Phi_1)/M \tag{1}$$

where $L=(((2\cdot n-1)\cdot Q+P\cdot\cos(\Delta\theta))/\sin(\Delta\theta))^2+P^2)^{1/2}$, $\theta_a=\cos^{-1}(2\cdot P/(D_f\cdot M))$, $\Phi_1=\sin^{-1}(P/((((2\cdot n-1)\cdot Q+P\cdot\cos(\Delta\theta))/\sin(\Delta\theta))^2+P^2)^{1/2})$, $\Delta\theta=\cos^{-1}(2\cdot Q/(D_f\cdot M))-\cos^{-1}(2\cdot P/(D_f\cdot M))$, and n is a natural number.

6. The multibeam exposure head according to claim 5, wherein if a width by which the position of the beam emitting port of said second multiple beam forming light source is shifted in the parallel arrangement direction relative to the position of the beam emitting port of said first multiple beam forming light source is Af, then Af obtained by the following equation (2) is set:

$$Af=(Wf\ddot{y}M\ddot{y}\ \sin(\ddot{y}a)+P)/(\cos\ (\ddot{y}a)\ddot{y}M) \quad (2).$$

7. The multibeam exposure head according to claim 1, wherein said multibeam light source has an optical fiber array.

8. The multibeam exposure head according to claim 1, wherein said tilt angle changing unit comprises a rotary unit and a base unit.

9. The multibeam exposure head according to claim 8, wherein said tilt angle changing unit further comprises a first member, a second member and a projecting member, wherein said first member, said second member are located between the rotary unit and base unit, and wherein said first member and said second member limit a tilt angle point by a predetermined range by limiting the movement of the projecting member fixed to the rotary unit.

10. The multibeam exposure head according to claim 1, wherein said tilt angle changing unit and an optical system are fixed to a movable table.

11. The multibeam exposure head according to claim 1, wherein said tilt angle change unit makes, by rotating said multibeam light source, said change in exposure condition from said first exposure condition to said second exposure condition in the subscanning direction.

12. The multibeam exposure head according to claim 1, wherein said multibeam light source comprises at most two beam forming light sources, wherein each beam forming light source comprises a plurality of beam emitting ports.

13. A multibeam exposure apparatus comprising:

a multibeam exposure head including a multibeam light source which exposes a recording material by main scanning, said multibeam light source having a first multiple beam forming light source in which a plurality of beam emitting ports are arranged parallel to each other while being spaced apart from each other by a predetermined distance, and a second multiple beam forming light source in which a plurality of beam emitting ports are arranged parallel to each other being spaced apart from each other by said predetermined distance, wherein said plurality of beam emitting ports in said second multiple beam forming light source are placed parallel to the parallel arrangement direction of the beam emitting ports in said first multiple beam forming light source while being spaced apart by a predetermined distance from the same, and the position of the beam emitting port at one end of said second multiple beam forming light source is shifted in the parallel direction relative to the position of the beam emitting port at the corresponding end of said first multiple beam forming light source;

a tilt angle changing unit, wherein said tilt angle changing unit rotates said multibeam light source to change an exposure condition from a first exposure condition to a second exposure condition during a subscan of a width of an area of a recording material; and an outer drum capable of performing main scanning on the recording material by having the recording material fitted and rotated around its outer cylindrical surface.

14. The multibeam exposure head according to claim 10, wherein each light source of the first multiple beam forming light source and the second multiple beam forming light source is arranged alternatively in a subscanning direction at a predetermined interval.

15. A multibeam exposure head comprising:

a multibeam light source which exposes a recording material by main scanning, said multibeam light source having a first multiple beam forming light source in which a plurality of beam emitting ports are arranged parallel to each other while being spaced apart from each other by a predetermined distance, and a second multiple beam forming light source in which a plurality of beam emitting ports are arranged parallel to each other being spaced apart from each other by said predetermined distance, wherein said plurality of beam emitting ports in said second multiple beam forming light source are placed parallel to the parallel arrangement direction of the beam emitting ports in said first multiple beam forming light source while being spaced apart by a predetermined distance from the same, and the position of the beam emitting port at one end of said second multiple beam forming light source being shifted in the parallel direction relative to the position of the beam emitting port at the corresponding end of said first multiple beam forming light source; and wherein said second multiple beam forming light source is shifted in the parallel direction relative to the position of the beam emitting port at the corresponding end of said first multiple beam forming light source by a distance such that an end most beam source of the first multiple beam forming light source and an end most beam source of the second multiple beam forming light source do not overlap each other.

* * * * *

UNITED STATES PATENT AND TRADEMARK OFFICE

CERTIFICATE OF CORRECTION

PATENT NO. : 6,771,299 B2
DATED : August 3, 2004
INVENTOR(S) : Ichirou Miyagawa

It is certified that error appears in the above-identified patent and that said Letters Patent is hereby corrected as shown below:

Column 12,
Line 55, delete "$W_f L \cdot \cos(\theta_a + \phi 1)/M$ ...(1)" and insert
-- $W_f = L \cdot \cos(\theta_a + \phi 1)/M$ ...(1) --;

Column 14,
Line 13, delete "according to claim 10" and insert -- according to claim 13 --.

Signed and Sealed this

Nineteenth Day of April, 2005

JON W. DUDAS
*Director of the United States Patent and Trademark Office*